US005156302A

United States Patent [19]

Kuitems

[11] Patent Number: 5,156,302

[45] Date of Patent: Oct. 20, 1992

[54] TWO-PART VALVE ASSEMBLY FOR OPENING OR CLOSING THE FLOW OF LIQUID FROM A CONTAINER

[75] Inventor: Timothy H. Kuitems, Paramount, Calif.

[73] Assignee: Tasco Molds, Inc., Paramount, Calif.

[21] Appl. No.: 653,644

[22] Filed: Feb. 11, 1991

[51] Int. Cl.[5] ..... B65D 47/06; B67D 3/04

[52] U.S. Cl. ..... 222/554; 222/531; 222/533; 222/556

[58] Field of Search ..... 222/531, 533, 536, 537, 222/553, 554, 556

[56] References Cited

U.S. PATENT DOCUMENTS

| | | | |
|---|---|---|---|
| 1,278,901 | 9/1918 | Ford | 222/554 |
| 1,726,642 | 9/1929 | Betts | 222/554 X |
| 1,967,797 | 7/1934 | White | 222/554 X |
| 2,127,424 | 8/1938 | Rolle | 222/554 X |
| 2,990,980 | 7/1961 | Gronemeyer | 222/554 X |
| 3,874,568 | 4/1975 | LaVange et al. | 222/531 X |
| 3,881,643 | 5/1975 | LaVange | 222/531 X |
| 4,282,991 | 8/1981 | Hazard | 222/531 |
| 4,645,086 | 2/1987 | Rosenthal | 222/536 X |
| 5,054,662 | 10/1991 | Santagiuliana | 222/531 |

*Primary Examiner*—Robert P. Olszewski
*Assistant Examiner*—Dean A. Reichard

[57] ABSTRACT

A two-part valve for opening or closing the flow of liquid from a container. The first part is a valve body which may be attached to the container, and the valve body has a frusto-spherical inner surface therein. The second part is a valve which has a generally spherical outer surface with a handle extending outwardly therefrom. A liquid passageway extends from the inner portion of the valve to an opening which may be moved inwardly or outwardly of the valve body depending upon the position of the valve handle.

6 Claims, 2 Drawing Sheets

TWO-PART VALVE ASSEMBLY FOR OPENING OR CLOSING THE FLOW OF LIQUID FROM A CONTAINER

BACKGROUND OF THE INVENTION

The field of the invention is valves, and the invention relates more particularly to low-cost water valves for turning on or off the flow of liquid from a water or other liquid container.

The most commonly used low-pressure water valve is a spring-loaded valve which must be manually held in a depressed position to open the valve for the flow of water. In some applications, it is beneficial to provide a valve which will remain open without having to be continually manually depressed. Most valves include an O-ring or other sealing means which both increases the cost of manufacturing and assembling the valve and also provides an area of potential leakage when the O-ring or other sealing member deteriorates.

SUMMARY OF THE INVENTION

It is an object of the present invention to provide a low-cost liquid valve which may be maintained in an open position without the need for continually depressing it.

The present invention is for a two-part valve for opening or closing the flow of liquid from a container. The valve has a first part comprising a valve body which is attachable to a container. The valve body has a container end and an outer end, and the container end includes thread means for affixing to the container. The valve body includes an inner surface portion which is part of a sphere adjacent the outer end thereof, which portion terminates at an inner end. This part of a sphere will be referred to herein by the coined word "frusto-spherical." The frusto-spherical portion surrounds the center of the imaginary sphere of which the frusto-spherical portion forms a part. The second part of the valve is a valve having a spherical outer surface with a portion removed about the same diameter as the imaginary sphere of the valve body. The shape of the valve will be referred to herein as incompletely spherical. The valve is movably held in a watertight manner by the frusto-spherical inner surface portion of the valve body. The valve has an outer portion extending outwardly away from the outer end of the valve body and an inner portion extending inwardly from the outer end of the valve body. The valve includes an outwardly extending handle held by the outer portion of the valve, and the valve has an inner liquid passageway which extends from an inlet in an area about opposite that of the handle and terminates in an outlet having a terminus. The terminus of the outlet is positioned along the surface of the incomplete sphere so that the movement of the handle moves the terminus between a point inwardly, with respect to said outer end, to a point outwardly of said outer end of said valve body. At least one of the valve body and the valve are fabricated from a flexible material so that the valve may be snapped into the valve body whereby the valve may be opened by moving the handle to a position where the terminus is outside of the outer end of the valve body, and the handle may also be moved to position the terminus inwardly of the valve body, thereby closing the valve. Preferably, the valve is a generally hollow sphere with a portion (but less than half) missing from a side thereof opposite the handle. Also, preferably, the opening is generally circular.

DESCRIPTION OF THE PREFERRED EMBODIMENTS

Figure 1:
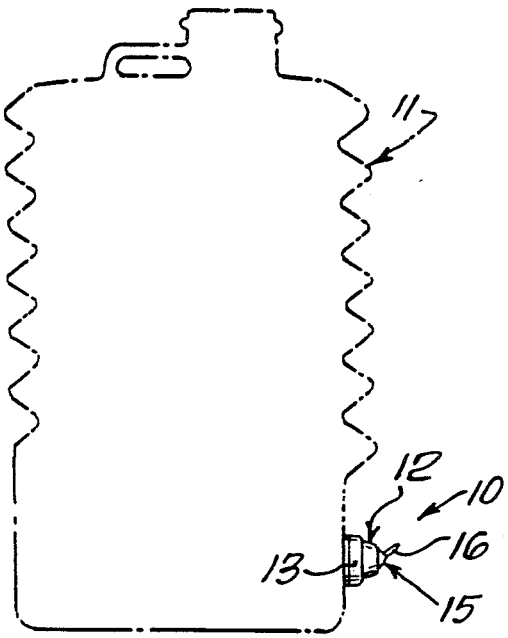
FIG. 1 is a side view of the valve of the present invention attached to a container shown in phantom view.

The valve assembly of the present invention is shown in FIG. 1 and identified by reference character 10. Valve assembly 10 is shown threadably affixed to a container 11 shown in phantom view. Container 11 is of the type described in U.S. Pat. No. 4,773,458. This type of container has an accordion sidewall and may be used in connection with a filter. By pushing downwardly on the top of container 11, water may be forced through such filter and outwardly through valve assembly 10. In order to manipulate this squeezing step, it is preferable that valve assembly 10 be of the type which will remain open without having to hold the valve manually.

Figure 2:
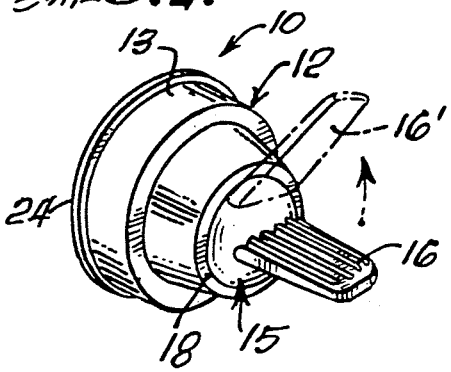
FIG. 2 is a perspective view of the valve assembly of the present invention.
Figure 6:
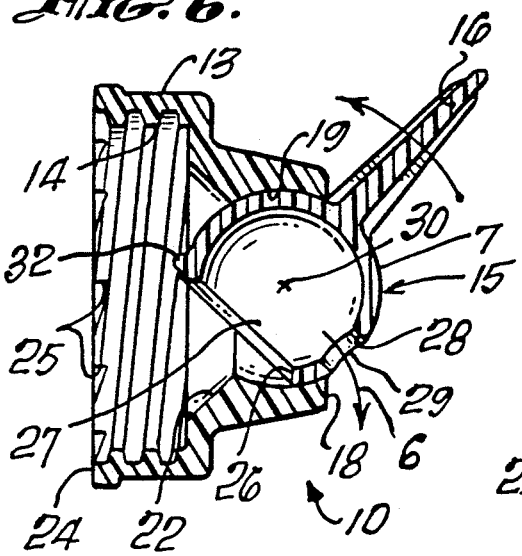
FIG. 6 is a cross-sectional view of the valve assembly of the present invention showing the valve in an opened position.
Figure 7:
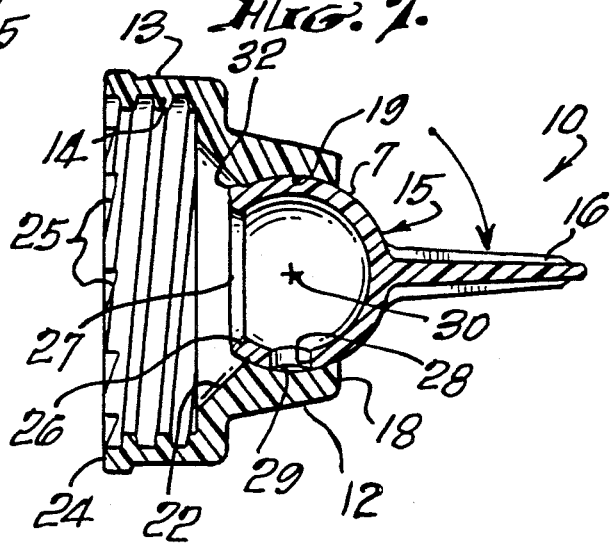
FIG. 7 is a cross-sectional view of the valve assembly of the present invention showing the valve in a closed position.

Valve assembly 10 is shown in perspective view in FIG. 2 and can be seen to have a valve body 12 which includes a ring portion 13 which has thread means 14 therein (shown in FIG. 3) for screwing the valve assembly onto the bottom threaded outlet of container 11. Valve assembly 10 also includes a valve 15 which has a handle 16 which may be moved between a closed position, shown in solid lines in FIG. 2, to an open position 16' shown in phantom line in FIG. 2. When handle 16 is in its opened position, an opening 28 extends past the outer end 18 of valve body 12. This provides a fluid passageway 6, as shown best in FIGS. 6 and 7, from within container 11 thereby permitting the flow of water or other liquid out of the container. When the valve handle 16 is moved to its closed position, shown in FIG. 7, the opening or passageway 28 has been moved past outer end 18 thereby prohibiting the flow of liquid as shown best in FIG. 7.

Figure 3:
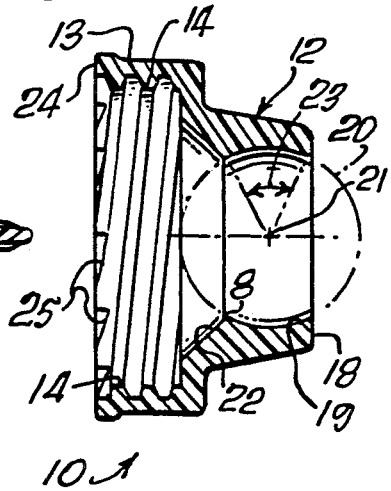
FIG. 3 is an enlarged cross-sectional view of the valve body of the valve assembly of the present invention.

The details of the valve body are shown best in cross-sectional view in FIG. 3 where it can be seen that valve body 12 includes a frusto-spherical inner surface 19 which forms a portion of imaginary sphere 20 which has a center 21. The frusto-spherical inner surface 19 subtends an arc 23. Arc 23 is about 60° which both permits the assembly of the valve into the valve body and yet holds the valve within the body. Center 21 is surrounded by the frusto-spherical inner surface 19 so that valve 15 is captured therein. It is important that either the valve body 12 or the valve 15 be fabricated from a flexible material so that the valve 15 may be snapped into the frusto-spherical inner surface 19 of the valve body 12. It is also preferable that the valve 15 be fabricated from a different material than valve body 12 so that there will not be a sticking or blocking of the valve against the frusto-spherical inner surface 19 of valve body 12.

The inner end of the frusto-spherical inner surface is indicated by reference character 8, and a frusto-conical portion 22 assists in the assembly of the valve 15 into valve body 12 when the valve is inserted past the frusto-conical portion. Valve body 12 has a container end 24 which includes a plurality of conventional notches 25. Notches 25 are used in the molding process to retain the valve body from rotating as the thread-forming core is removed by unscrewing it from the valve body. Of course, a washer is also typically positioned between the container opening and the valve assembly to prevent leaking.

Figure 4:
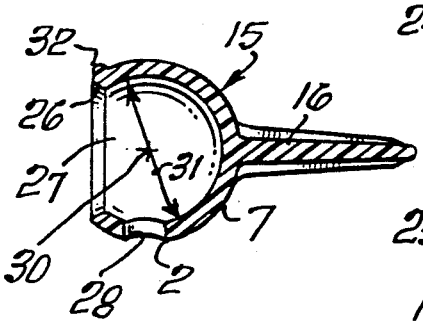
FIG. 4 is a cross-sectional view of the valve of the valve assembly of the present invention.

The details of the valve are shown best in FIG. 4 where it can be seen that the valve is basically a hollow sphere with a portion cut out leaving a circular opening 26. The valve 15 has an incompletely spherical outer surface 7. Opening 26 has a center 27 which is about opposite handle 16. Valve 15 also has a circular outlet 28 which has an outermost point 29. The spherical valve has a center 30, and an imaginary diameter 31 is shown perpendicular to handle 16 in FIG. 4.

Figure 5:
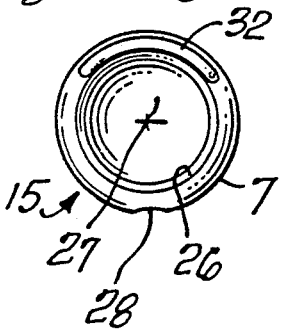
FIG. 5 is a rear view of the valve of FIG. 4.

The valve is shown from the rear in FIG. 5 where circular opening 26 may be clearly seen.

Figure 8:
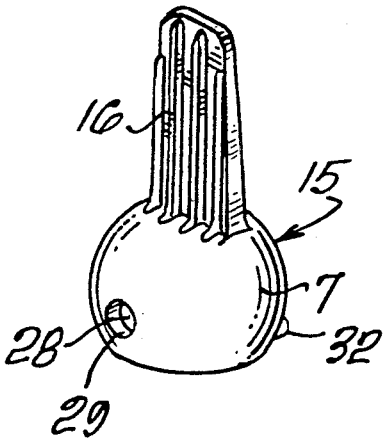
FIG. 8 is a perspective view of the valve of the valve assembly of FIG. 2.
Figure 9:
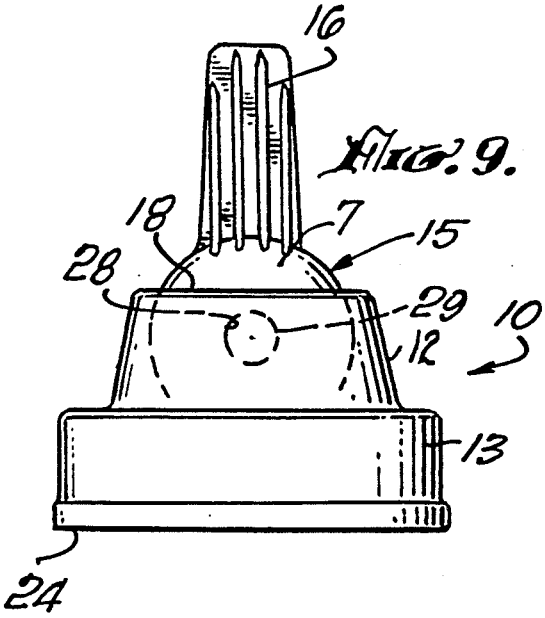
FIG. 9 is a bottom view of the valve assembly of the present invention.

The valve is shown in perspective view in FIG. 8 where it can be seen that handle 16 is a generally flat tab which permits the easy turning of the valve within the valve body 12. This assists in directing the flow of water when necessary and also permits the positioning of the outlet 28 at the lower portion of the valve 15 or in a preferred angular position.

A ridge 32 is formed along from 10 ° to 180° and preferably about 90° of the circular opening 26. This is shown best in FIGS. 4 and 5. Ridge 32 prevents handle 16 from moving too far downwardly. (See FIG. 7.) In this way, the entire incompletely spherical surface 7 will contact the entire frusto-spherical inner surface 19 when the valve is closed to provide the maximum sealing surface. Ridge 32 also assists in positioning valve 15 in a fully closed position in that as the user pushes downwardly on the handle 16, the contact between ridge 32 and frusto-conical portion 22 tends to align the valve into a fully closed position.

The preferred materials of construction include polyethylene for the valve body and polypropylene for the valve. The use of such materials provides sufficient flexibility so that the valve may be snapped into the valve body and yet will not easily become dislodged from the valve body in use.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A two-part valve assembly for opening or closing the flow of liquid from a container, said valve assembly comprising:

a first part comprising a valve body attachable to a container, said valve body having a container end and an outer end, said container end including thread means for affixing the valve body to a container and said valve body having a frusto-spherical inner surface portion adjacent the outer end and terminating at a frusto-spherical inner end, said frusto-spherical portion surrounding the center of an imaginary sphere of which the frusto-spherical portion forms a part;

a second part comprising a valve comprising a generally hollow sphere with a portion missing therefrom forming a circular opening in said generally hollow sphere having an outer surface essentially the same diameter as the imaginary sphere of said valve body and said valve being movable with respect to said valve body and held in a watertight manner by said frusto-spherical inner surface portion of said valve body, said valve having an outer portion extending outwardly away from the outer end of said valve body and an inner portion extending inwardly from said outer end of said valve body, said valve including an outwardly extending handle held by the outer portion of said valve and said valve having an inner liquid passageway including a liquid outlet through the side of said generally hollow sphere at least a portion thereof being positioned past the diameter of said generally hollow sphere which is perpendicular to said handle, said liquid outlet being spaced from the handle so that the movement of the handle moves the liquid outlet between a point inwardly with respect to said outer end to a point outwardly of said outer end of said valve body and said handle being shaped to permit the positioning of the liquid outlet in a preferred angular position and wherein at least one of said valve body and said valve is fabricated from a flexible material so that the valve may be snapped into the valve body, said first and second parts being joined to form a self-contained valve assembly whereby the valve may be opened and positioned by moving the handle to position the liquid outlet outwardly of said outer end of the valve body and also may be closed by manipulating the valve to move said liquid outlet inwardly of said outer end of said valve body; and further including a ridge extending from 10° to 180° about the outer edge of the circular opening of the hollow sphere of the valve, said ridge being oriented so that it is centered opposite the opening through the side of the valve.

2. The two-part valve assembly of claim 1 wherein said valve is fabricated from polypropylene.

3. The two-part valve assembly of claim 1 wherein said valve body is fabricated from polyethylene.

4. The two-part valve assembly of claim 1 wherein said frusto-spherical inner surface subtends an arc of about 60°.

5. The two-part valve assembly of claim 1 wherein said handle is a generally flat member.

6. The two part valve assembly of claim 1 wherein the ridge extends over about 90°.

* * * * *